US010944176B2

(12) United States Patent
Ma et al.

(10) Patent No.: US 10,944,176 B2
(45) Date of Patent: Mar. 9, 2021

(54) LOW PROFILE WIDEBAND ANTENNA

(71) Applicant: AGENCY FOR SCIENCE, TECHNOLOGY AND RESEARCH, Singapore (SG)

(72) Inventors: Yugang Ma, Singapore (SG); Pankaj Sharma, Singapore (SG); Ser Wah Oh, Singapore (SG)

(73) Assignee: AGENCY FOR SCIENCE, TECHNOLOGY AND RESEARCH, Singapore (SG)

( * ) Notice: Subject to any disclaimer, the term of this patent is extended or adjusted under 35 U.S.C. 154(b) by 225 days.

(21) Appl. No.: 16/089,352

(22) PCT Filed: Mar. 28, 2017

(86) PCT No.: PCT/SG2017/050165
§ 371 (c)(1),
(2) Date: Sep. 27, 2018

(87) PCT Pub. No.: WO2017/171642
PCT Pub. Date: Oct. 5, 2017

(65) Prior Publication Data

US 2020/0313302 A1 Oct. 1, 2020

(30) Foreign Application Priority Data

Mar. 29, 2016 (SG) ..... 10201602454V

(51) Int. Cl.
*H01Q 9/40* (2006.01)
*H01Q 1/48* (2006.01)
(Continued)

(52) U.S. Cl.
CPC ..... *H01Q 9/40* (2013.01); *H01Q 1/48* (2013.01); *H01Q 9/42* (2013.01); *H01Q 13/16* (2013.01)

(58) Field of Classification Search
CPC .. H01Q 9/40; H01Q 9/42; H01Q 1/48; H01Q 13/16
See application file for complete search history.

(56) References Cited

U.S. PATENT DOCUMENTS 7,046,199 B2 * 5/2006 Montgomery ..... H01Q 1/36 343/700 MS
2004/0217910 A1 11/2004 Montgomery et al.
(Continued)

FOREIGN PATENT DOCUMENTS

CN 104300209 A 1/2015
WO WO 2005/064745 A1 7/2005

OTHER PUBLICATIONS

PCT International Search Report for PCT Counterpart Application No. PCT/SG2017/050165, 4 pgs. (dated Jun. 18, 2017).
(Continued)

*Primary Examiner* — Hoang V Nguyen
(74) *Attorney, Agent, or Firm* — Womble Bond Dickinson (US) LLP

(57) ABSTRACT

A low-profile wideband monopole antenna is provided. The antenna may include a radiating element configured in a bent monopole arrangement to provide a vertical polarization such that an omni-directional radiating characteristic is achieved. The radiating element may include a plurality of slots formed at or edged from each side of the radiating element to increase the effective current path length of the radiating element. The antenna may include a feed and a feeding structure extending from the radiating element to the feed. The antenna may further include a ground plane. The radiating element may be arranged substantially parallel to the ground plane. The surface area of the radiating element may be smaller than the ground plane.

14 Claims, 10 Drawing Sheets

(51) Int. Cl.
*H01Q 9/42* (2006.01)
*H01Q 13/16* (2006.01)

(56) References Cited

U.S. PATENT DOCUMENTS

2005/0162321 A1 7/2005 Colburn et al.
2012/0235772 A1* 9/2012 Sheta ..... H01P 7/082
333/204

OTHER PUBLICATIONS

PCT Written Opinion of the International Searching Authority for PCT Counterpart Application No. PCT/SG2017/050165, 4 pgs. (dated Jun. 18, 2017).

* cited by examiner

800

LOW PROFILE WIDEBAND ANTENNA

CROSS-REFERENCE TO RELATED APPLICATION(S)

This patent application is a U.S. National Phase Application under 35 U.S.C. § 371 of International Application No. PCT/SG2017/050165, filed on 28 Mar. 2017, entitled LOW PROFILE WIDEBAND ANTENNA, which claims the benefit of Singapore Patent Application No. 10201602454V, entitled "Low profile wideband antenna for TVWS systems" and filed on Mar. 29, 2016, which was expressly incorporated by reference herein in its entirety.

TECHNICAL FIELD

Various aspects of this disclosure generally relate to wireless communication, and more particularly, to a wideband low profile antenna.

BACKGROUND

For some applications, the antenna size in antenna polarization direction is restricted by environment. For example, when the system circuit module enclosure is already fixed and user desires to integrate the antenna and circuit module in the same enclosure, the antenna size in antenna polarization direction is restricted.

A monopole antenna is a class of radio antenna consisting of a straight rod-shaped conductor, often mounted perpendicularly over some type of conductive surface, called a ground plane. The monopole is a resonant antenna; the rod functions as an open resonator for radio waves, oscillating with standing waves of voltage and current along its length. Therefore, the length of the antenna is determined by the wavelength of the radio waves it is used with. The most common form is the quarter-wave monopole, in which the antenna is approximately a quarter wavelength of the covered working frequency. For example, if the lowest frequency is 610 MHz, the pole height of the monopole antenna may need to be about 12.3 cm. With a big ground plane, a traditional monopole antenna may be too high to be enclosed in the circuit module case. Even for stand-alone ceiling or equipment box-top deployment, the huge antenna case may be unstable and inconvenient.

A low profile wideband monopole antenna is a monopole antenna with low height and wide impedance bandwidth. For scenarios in which the antenna size in antenna polarization direction is restricted, a low profile monopole antenna may be desirable.

SUMMARY

The following presents a simplified summary of one or more aspects in order to provide a basic understanding of such aspects. This summary is not an extensive overview of all contemplated aspects, and is intended to neither identify key or critical elements of all aspects nor delineate the scope of any or all aspects. Its sole purpose is to present some concepts of one or more aspects in a simplified form as a prelude to the more detailed description that is presented later.

In an aspect of the disclosure, a low-profile wideband monopole antenna is provided. The antenna may include a radiating element configured in a bent monopole arrangement to provide a vertical polarization such that an omni-directional radiating characteristic is achieved. The radiating element may include a plurality of slots formed at or edged from each side of the radiating element to increase the effective current path length of the radiating element. The antenna may include a feed. The antenna may further include a feeding structure extending from the radiating element to the feed. The antenna may include a ground plane. The radiating element may be arranged substantially parallel to the ground plane. The surface area of the radiating element may be smaller than the ground plane to reduce coupling effects between the radiating element and the ground plane, and to mitigate reduction in antenna gain.

The antenna may further include a supporting structure to support the feeding structure. The antenna may further include a first substrate. The radiating element may be disposed on one side of the first substrate. The antenna may further include a second substrate. The ground plane may be disposed on one side of the second substrate. A first printed circuit board (PCB) may form the first substrate and a second PCB may form the second substrate.

The primary resonance frequency of the antenna may be dependent on the length of the supporting structure and the dimension of the radiating element. The supporting structure may be a cylindrical structure extending from the radiating element to a supporting substrate or plate.

The antenna may further include a plurality of stubs extending from the radiating element to the second substrate, and arranged around the supporting structure. The plurality of stubs may be non-shorted to the ground plane to avoid forming a loop antenna. The arrangement of the distance from the plurality of stubs to edges of the first substrate may enlarge antenna's impedance bandwidth. Moreover, the impedance bandwidth of the antenna may also be affected by the projection areas of the feeding structure and the stubs to the ground plane.

In another aspect of the disclosure, a method for providing an antenna is provided. The method may bend a pole of the antenna to form a radiating element and a feeding structure. The feeding structure may extend from the radiating element to a feed. The radiating element may provide a vertical polarization such that an omni-directional radiating characteristic is achieved. The method may provide a ground plane.

The bending of the pole may further form a supporting structure that supports the feeding structure. The radiating element may be disposed on one side of a first substrate, and the ground plane may be disposed on one side of a second substrate. The method may further provide a plurality of stubs extending from the radiating element to the second substrate, and arranged around the supporting structure. The radiating element may be arranged substantially parallel to the ground plane. The method may further etch a plurality of slots at each side of the radiating element to increase the effective current path length of the radiating element. The bending of the pole may further form a supporting structure that supports the feeding structure. The radiating element may be disposed on one side of a first substrate, and the ground plane may be disposed on one side of a second substrate. The method may further provide a plurality of stubs extending from the radiating element to the second substrate, and arranged around the supporting structure.

To the accomplishment of the foregoing and related ends, the one or more aspects include the features hereinafter fully described and particularly pointed out in the claims. The following description and the annexed drawings set forth in detail certain illustrative features of the one or more aspects. These features are indicative, however, of but a few of the various ways in which the principles of various aspects may be employed, and this description is intended to include all such aspects and their equivalents.

DETAILED DESCRIPTION

The detailed description set forth below in connection with the appended drawings is intended as a description of various configurations and is not intended to represent the only configurations in which the concepts described herein may be practiced. The detailed description includes specific details for the purpose of providing a thorough understanding of various concepts. However, it will be apparent to those skilled in the art that these concepts may be practiced without these specific details. In some instances, well known structures and components are shown in block diagram form in order to avoid obscuring such concepts.

Several aspects of a low profile wideband antenna will now be presented with reference to various apparatus and methods. The apparatus and methods will be described in the following detailed description and illustrated in the accompanying drawings by various blocks, components, circuits, processes, algorithms, etc. (collectively referred to as "elements"). The elements may be implemented using electronic hardware, computer software, or any combination thereof. Whether such elements are implemented as hardware or software depends upon the particular application and design constraints imposed on the overall system.

In one embodiment, a low profile monopole antenna design is provided. In one embodiment, the height of the antenna may be as small as 0.06 wavelength of the lowest covered frequency. In one embodiment, the average gain of the antenna in the x-y working plane may be 1 dBi. In one embodiment, the area of the antenna may be 230 mm×230 mm, which is smaller than half wavelength×half wavelength of the lowest covered frequency. In one embodiment, the low profile monopole antenna may be used for ultra high frequency (UHF) or TV white space (TVWS) systems.

Figure 1:
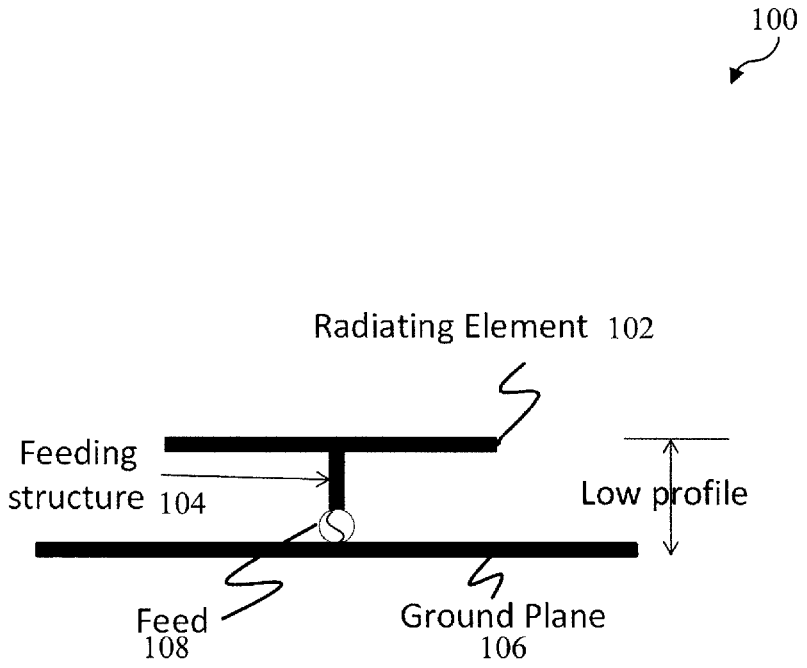
FIG. 1 is a diagram illustrating a side view of a low profile monopole antenna in accordance with one embodiment of the disclosure.

FIG. 1 is a diagram illustrating a side view of a low profile monopole antenna 100 in accordance with one embodiment of the disclosure. As illustrated, the low profile monopole antenna 100 may include a radiating element 102, a feeding structure 104, a feed 108, and a ground plane 106.

The radiating element 102 may be configured in a bent monopole arrangement to provide a vertical polarization such that an omni-directional radiating characteristic is achieved. The feeding structure 104 may extend from the radiating element 102 to the feed 108. In one embodiment, the radiating element 102 and the feeding structure 104 may form the bent monopole of the low profile monopole antenna 100.

The feed 108 may feed the radio waves to the rest of the low profile monopole antenna 100. In receiving mode, the feed 108 may collect the incoming radio waves, convert them to electric currents, and transmit them to the receiver.

The ground plane 106 may be a conducting surface large in comparison to the wavelength. In one embodiment, the ground plane 106 may be connected to the transmitter's ground wire.

In one embodiment, the radiating element 102 may be arranged substantially parallel to the ground plane 106. As illustrated, the distance between the radiating element 102 and the ground plane 106 may be small to maintain the low profile of the antenna 100.

The surface area of the radiating element 102 may preferably be dimensionally smaller than the ground plane 106 to reduce coupling effects between the radiating element 102 and the ground plane 106, and to mitigate any reduction in antenna gain.

Figure 2:
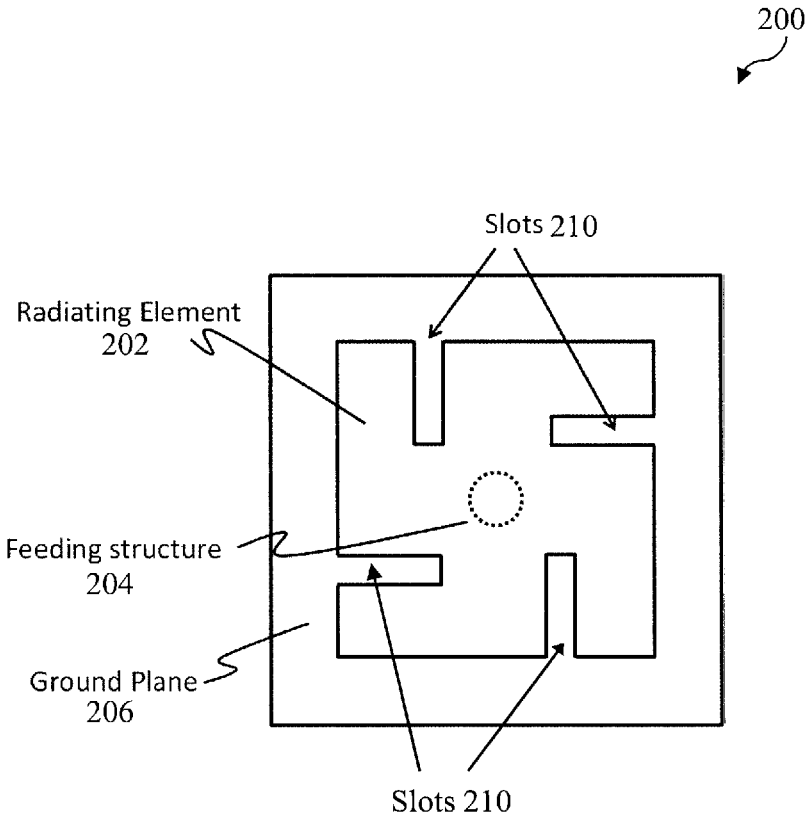
FIG. 2 is a diagram illustrating a top view of a low profile monopole antenna in accordance with one embodiment of the disclosure.

FIG. 2 is a diagram illustrating a top view of a low profile monopole antenna 200 in accordance with one embodiment of the disclosure. As illustrated, the low profile monopole antenna 200 may include a radiating element 202, a feeding structure 204, and a ground plane 206. In one embodiment, the low profile monopole antenna 200 may be the low profile monopole antenna 100 described above with reference to FIG. 1. In such an embodiment, the radiating element 202 may be the radiating element 102 described above with reference to FIG. 1, the feeding structure 204 may be the feeding structure 104 described above with reference to FIG. 1, and the ground plane 206 may be the ground plane 106 described above with reference to FIG. 1.

In one embodiment, a plurality of slots 210 may be formed at or edged from each side of the radiating element 202. As described above, the surface area of the radiating element 202 may be dimensionally smaller than the ground plane 206 to reduce coupling effects between the radiating element 202 and the ground plane 206, and to mitigate any reduction in antenna gain. The plurality of slots 210 may be used to increase the effective current path length of the radiating element 202 to counteract the reduced dimensions of the radiating element 202.

Figure 3:
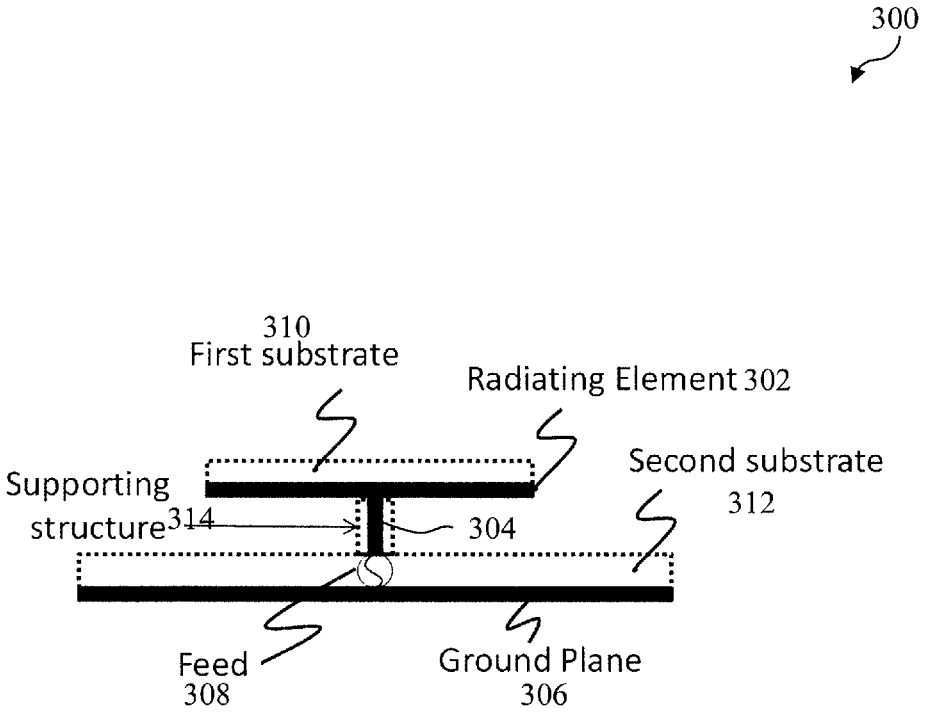
FIG. 3 is a diagram illustrating a side view of a low profile monopole antenna in accordance with another embodiment of the disclosure.

FIG. 3 is a diagram illustrating a side view of a low profile monopole antenna 300 in accordance with another embodiment of the disclosure. As illustrated, the low profile monopole antenna 300 may include a radiating element 302, a feeding structure 304, a feed 308, and a ground plane 306. In one embodiment, the radiating element 302 may be similar to the radiating element 102 or 202 described above, the feeding structure 304 may be similar to the feeding structure 104 or 204 described above, the feed 308 may be similar to the feed 108 described above, and the ground plane 306 may be similar to the ground plane 106 or 206 described above.

In one embodiment, the low profile monopole antenna 300 may further include a supporting structure 314, a first substrate 310, and a second substrate 312. The supporting structure 314 may be used to support the feeding structure 304. In one embodiment, the radiating element 302 may be disposed on one side of the first substrate 310. In one embodiment, the ground plane 306 may be disposed on one side of the second substrate 312.

In one embodiment, the low profile monopole antenna 300 may form a primary resonance frequency that is dependent on the length of the supporting structure 314 and the dimension of the radiating element 302. In one embodiment, the supporting structure 314 may be a cylindrical structure extending from the radiating element 302 to a supporting substrate or plate (e.g., the second substrate 312).

Figure 4:
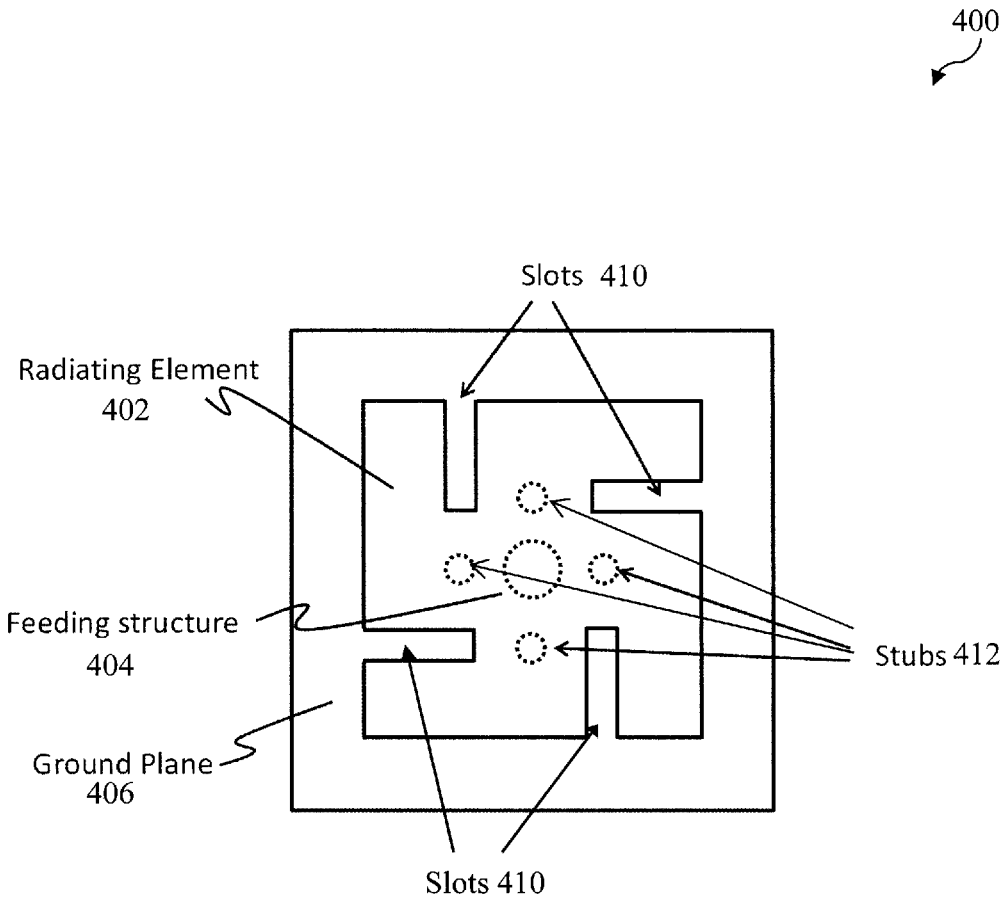
FIG. 4 is a diagram illustrating a top view of a low profile monopole antenna in accordance with another embodiment of the disclosure.

FIG. 4 is a diagram illustrating a top view of a low profile monopole antenna 400 in accordance with another embodiment of the disclosure. As illustrated, the low profile monopole antenna 400 may include a radiating element 402, a feeding structure 404, and a ground plane 406. In one embodiment, the radiating element 402 may be similar to the radiating element 102, 202, or 302 described above, the feeding structure 404 may be similar to the feeding structure 104, 204, or 304 described above, and the ground plane 406 may be similar to the ground plane 106, 206, or 306 described above. In one embodiment, the radiating element 402 may include a plurality of slots 410 that are similar to the slots 210 described above with reference to FIG. 2.

In one embodiment, a plurality of stubs 412 may extend from the radiating element 402 to the second substrate 312 described above, and arranged around the supporting structure 314 described above. The arrangement may advantageously enlarge the impedance bandwidth. In addition, the stubs 412 may form further supporting structure for the radiating element 402 from the ground plane 406. In one embodiment, the stubs 412 are non-shorted to the ground plane 406 to avoid forming a loop antenna.

Figure 5:
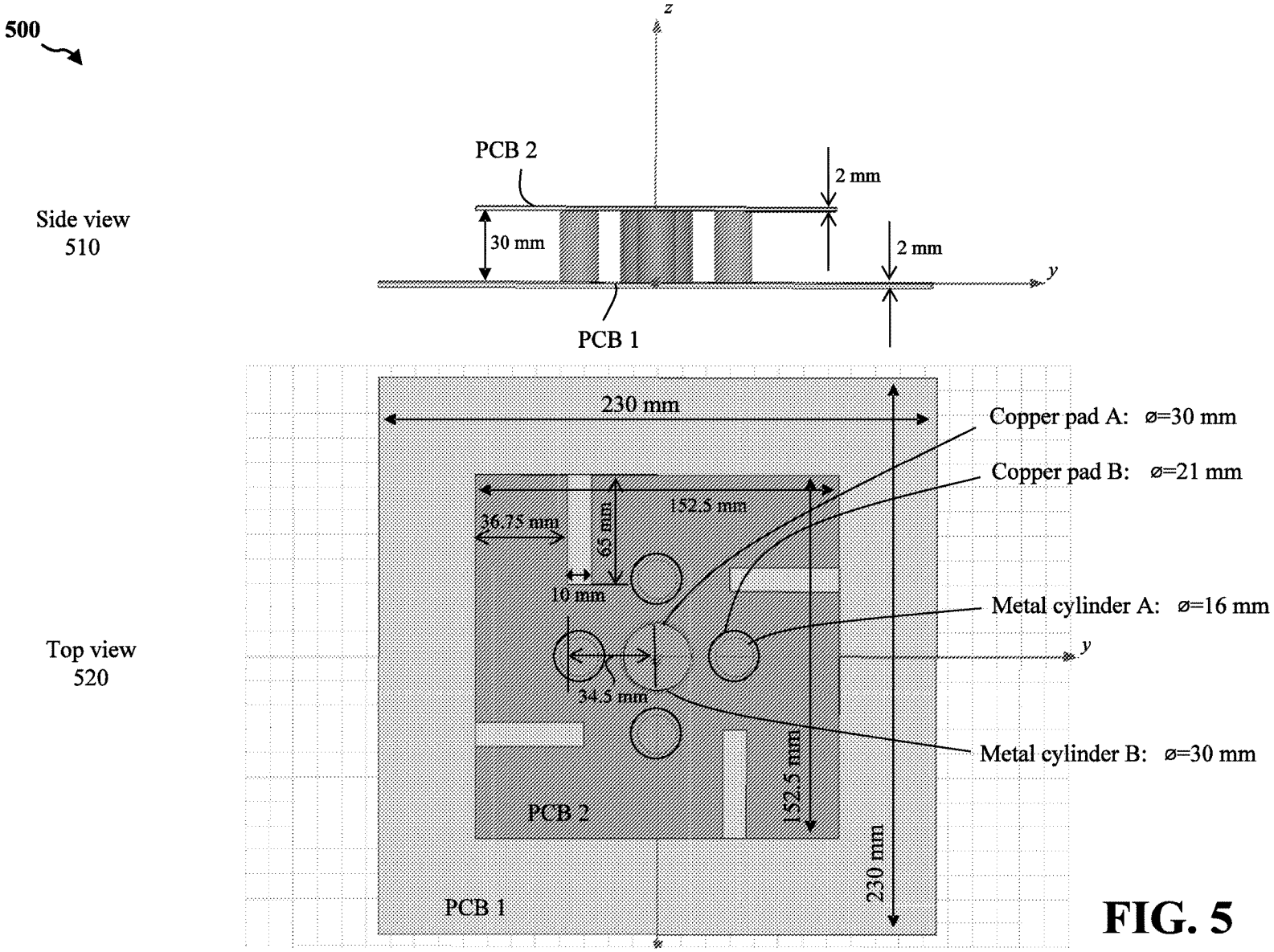
FIG. 5 is an example design of a low profile monopole antenna structure of some embodiments.

FIG. 5 is an example design of a low profile monopole antenna structure 500 of some embodiments. In one embodiment, the low profile monopole antenna structure 500 may be the low profile monopole antenna 100, 200, 300, or 400 described above. A side view 510 and a top view 550 of the low profile monopole antenna structure 500 are illustrated in FIG. 5. In this example, PCB1 forms the second substrate with the ground plane while PCB2 represents the first substrate with the radiating element on it. Dimensions illustrated in FIG. 5 may serve as an example to meet the requirements of achieving an impedance bandwidth in UHF range.

In one embodiment, to achieve the low profile requirement, the first step may be to bend the pole of a monopole antenna. In the various embodiments described above, the pole may be the feeding structure or the cylindrical structure. The bent pole may be extended to horizontal direction. This extension may be in a horizontal direction along the plane of the PCB2.

However, simply bending the pole and extend it in horizontal plane will result in a narrow impedance bandwidth and small gain. The more the extension, the narrower is the bandwidth and the smaller the gain. For example, for a TVWS application, the working frequency range may be from 614 MHz to 742 MHz. As a result, the TVWS application may require a wideband low-profile monopole antenna. To enlarge the impedance bandwidth of the low profile monopole antenna structure, a plurality of (e.g., four) stubs (e.g., the stubs 412) may be introduced for the bended PCB pole. By controlling the distance from the stubs to ground and/or the size of the patch on the top of PCB2, the monopole radiation impedance may be adjusted. By controlling the distance from the stubs to the edge of PCB2, the second resonant frequency may be adjusted. In one embodiment, the shorter the distance from the stubs to the edge of the PCB2, the higher the second resonance frequency. The primary resonant frequency may be determined by the supporting structure height and the size of the PCB2. Consequently, the wideband requirement may be achieved by adjusting one or more of the height of the supporting structure, the size of the PCB2, or the distance from the stubs to the edges of PCB2.

To avoid reducing antenna gain, which is a common problem in the low profile monopole antenna design, the extension of the bended pole (the size of PCB) may be limited. Instead, a plurality of (e.g., four) slots (e.g., slots 210, 410) may be etched from PCB2 as showed in FIG. 2 or FIG. 4. These slots may increase the primary resonant frequency without increasing the size of PCB2 significantly.

The stubs (e.g., 412) on the pole are not shorted loop to ground, and still belong to the pole. This is different from the conventional methods. If the stubs are shorted to ground, a loop antenna mechanism is introduced, thereby affecting the radiation pattern and gain. More importantly, the second resonance frequency calculation is totally different. The combination of the slots and stubs may become challenging.

Figure 6:
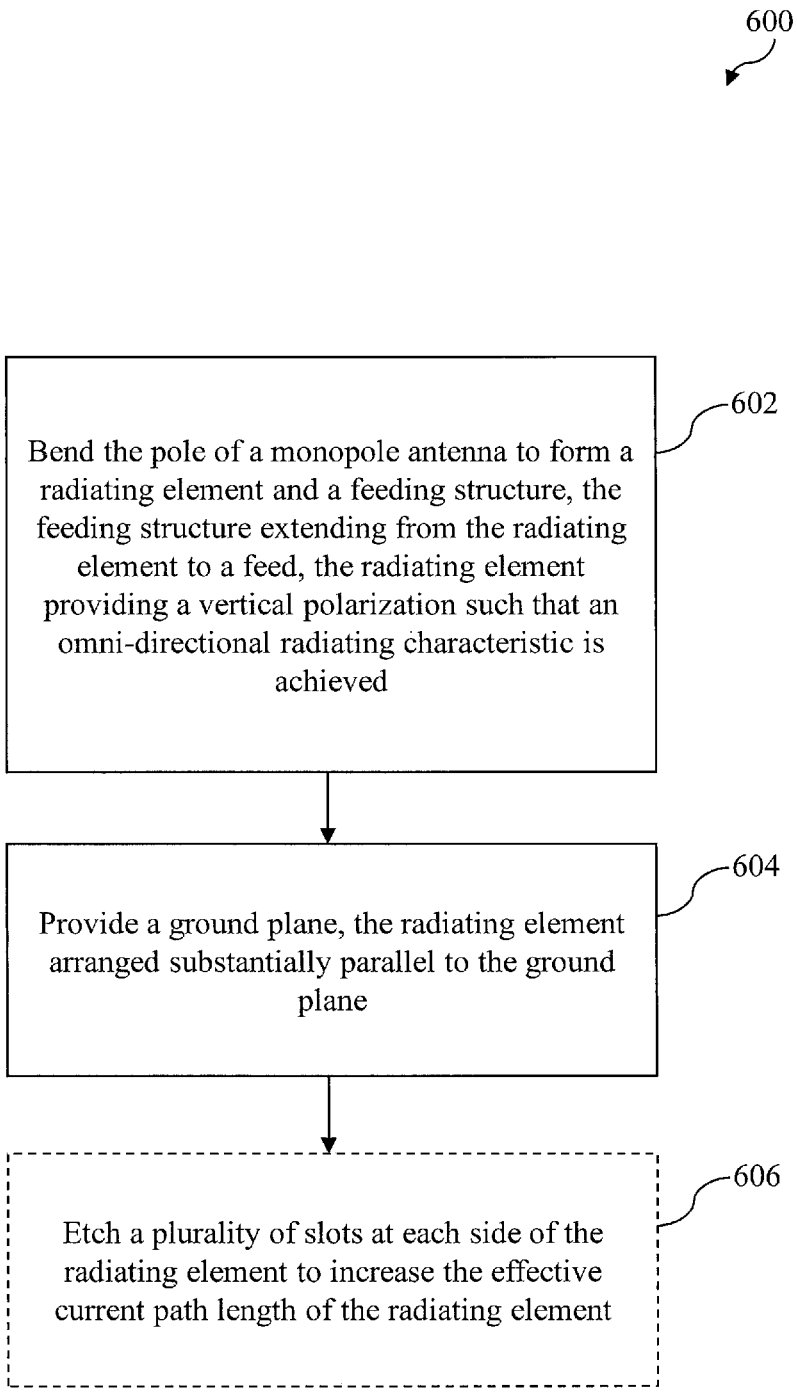
FIG. 6 is a flowchart of a method of providing a low profile wideband monopole antenna accordingly to one embodiment of the disclosure.

FIG. 6 is a flowchart 600 of a method of providing a low profile wideband monopole antenna accordingly to one embodiment of the disclosure. In one embodiment, the low profile wideband monopole antenna provided by this method may be the low profile monopole antenna described above with reference to FIG. 1, 2, 3, 4, or 5. At 602, the method may bend the pole of a monopole antenna to form a radiating element and a feeding structure. The feeding structure may extend from the radiating element to a feed. The radiating element may provide a vertical polarization such that an omni-directional radiating characteristic is achieved.

At 604, the method may provide a ground plane. In one embodiment, the radiating element may be arranged substantially parallel to the ground plane. In one embodiment, the surface area of the radiating element may be smaller than the ground plane to reduce coupling effects between the radiating element and the ground plane, and to mitigate reduction in antenna gain.

At 606, the method may optionally etch a plurality of slots at each side of the radiating element to increase the effective current path length of the radiating element. In one embodiment, the plurality of slots may increase the primary resonant frequency of the antenna. In other words, for a given central working frequency, the size of PCB 2 having slots on the radiating element can be smaller than the size of PCB2 without slots on the radiating element.

In one embodiment, the bending of the pole may further form a supporting structure that supports the feeding structure. The radiating element may be disposed on one side of a first substrate. The ground plane may be disposed on one side of a second substrate. In one embodiment, the primary resonance frequency of the antenna may be dependent on the length of the supporting structure and the dimension of the radiating element. In one embodiment, the supporting structure may be a cylindrical structure extending from the radiating element to a supporting substrate or plate. In one embodiment, the method may further provide a plurality of stubs extending from the radiating element to the second substrate, and arranged around the supporting structure. In one embodiment, the plurality of stubs may be non-shorted to the ground plane to avoid forming a loop antenna. The arrangement of the plurality of stubs may enlarge the impedance bandwidth of the antenna.

Figure 7:
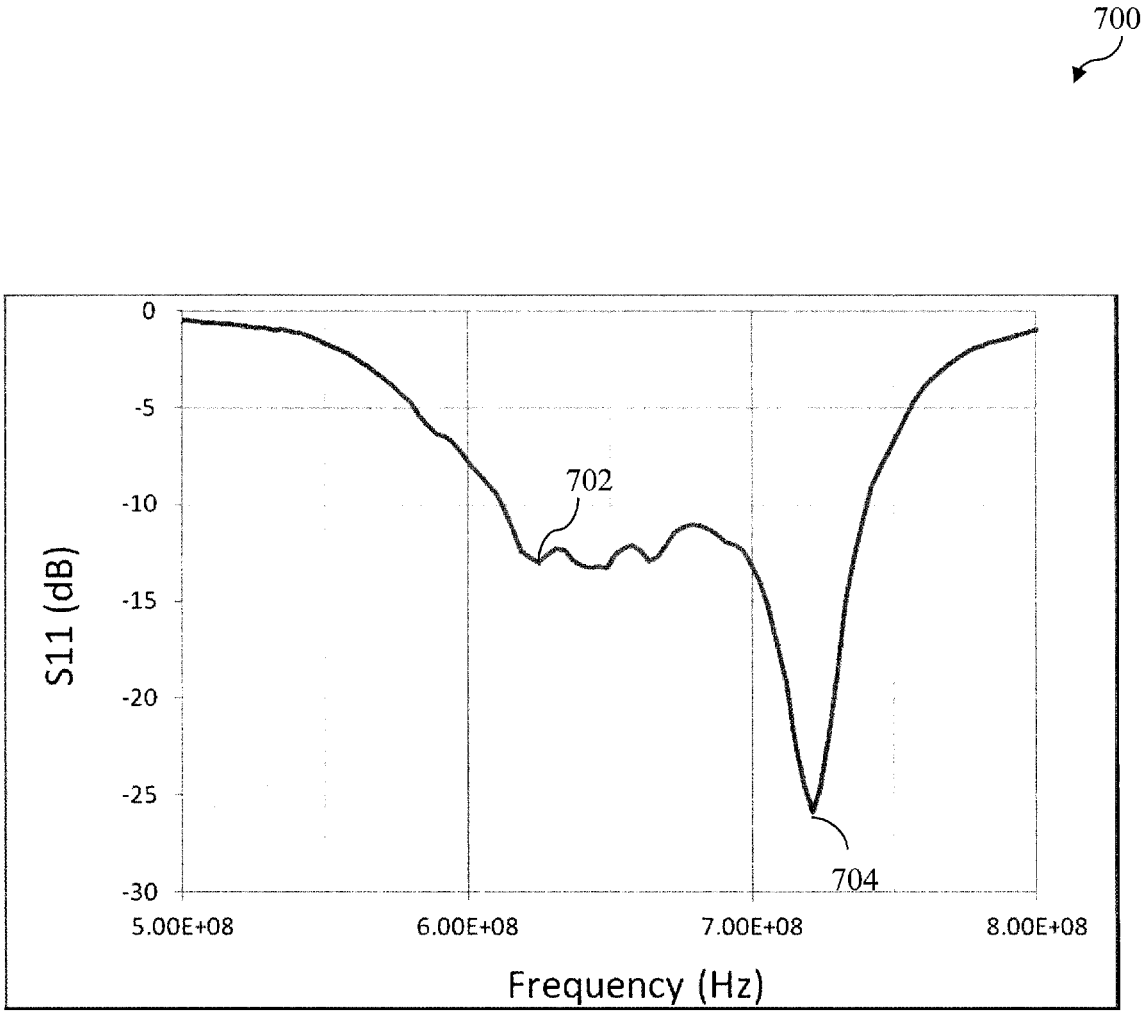
FIG. 7 is a chart showing the return loss of the example low profile monopole antenna described in FIG. 5.

FIG. 7 is a chart 700 showing the return loss of the example low profile monopole antenna described in FIG. 5. There are two prominent resonances, which make the antenna impedance bandwidth wide. The first resonance 702 is at 620 MHz. The first resonance 702 may be determined by the height of the antenna, the size of PCB2, and the length of each slot. The second resonance 704 is at 720 MHz. The second resonance 704 may be determined by the distance from the stubs to the edges of PCB 2. The structure described above with reference to FIGS. 1-5 may help achieve the required impedance bandwidth of 614 MHz to 740 MHz.

Figure 8:
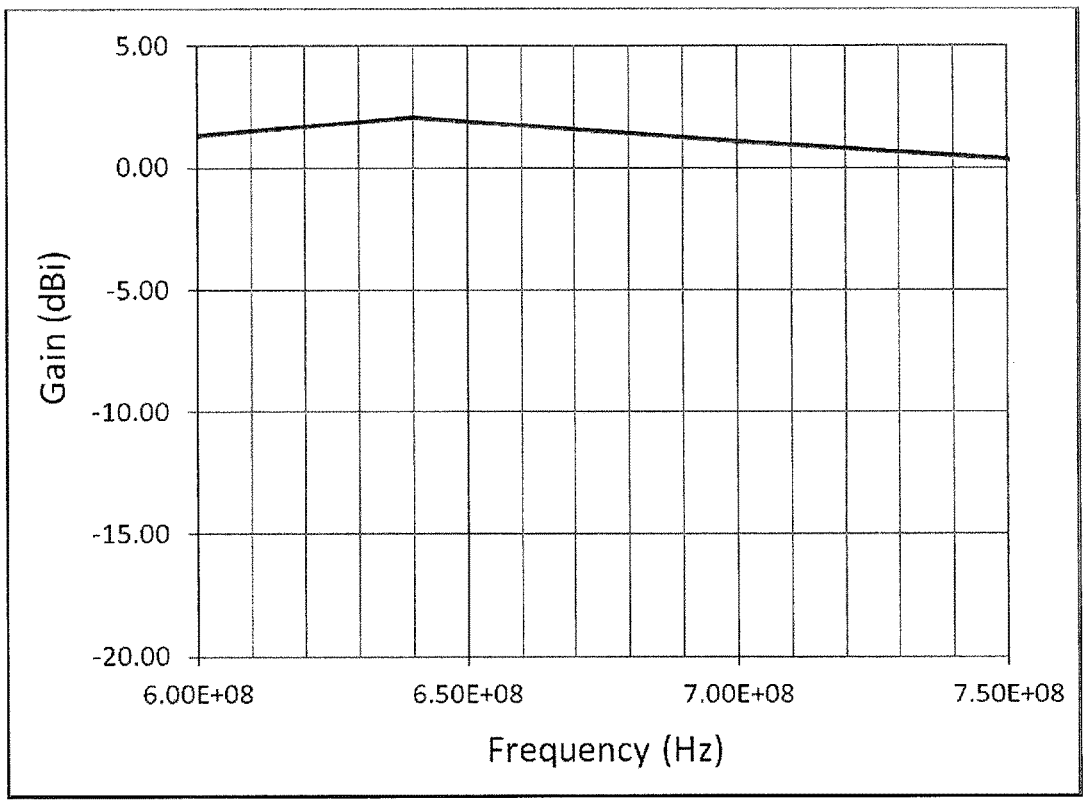
FIG. 8 is a chart showing the antenna gain versus frequency in x-y plane along the ground plane.

FIG. 8 is a chart 800 showing the antenna gain versus frequency in x-y plane (azimuth plane) along the ground plane. As illustrated, the gain in working plane is 1 dBi on average. Comparing with the same size full height monopole antenna, the low-profile antenna has no visible gain reduction.

Figure 9:
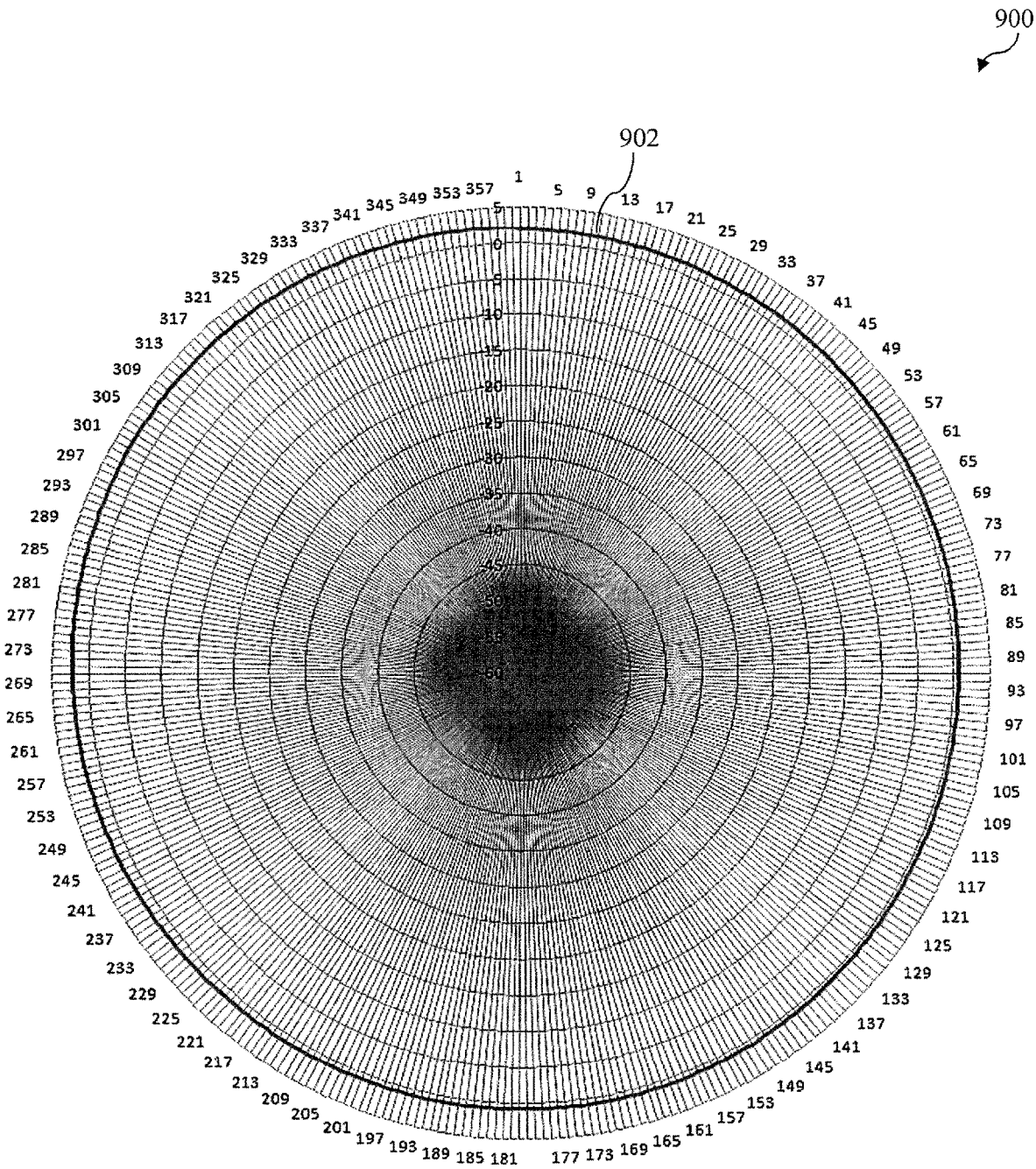
FIG. 9 is a diagram showing the radiation pattern of the antenna in different directions in x-y plane for the example design in FIG. 5.

FIG. 9 is a diagram 900 showing the radiation pattern of the antenna in different directions in x-y plane for the example design in FIG. 5. As illustrated in FIG. 9, the antenna has stable and uniform gain 902 in x-y plane. The gain variation in x-y plane is about 2 dB. The gain 902 in all direction in x-y plane is greater than 0 dBi.

Figure 10:
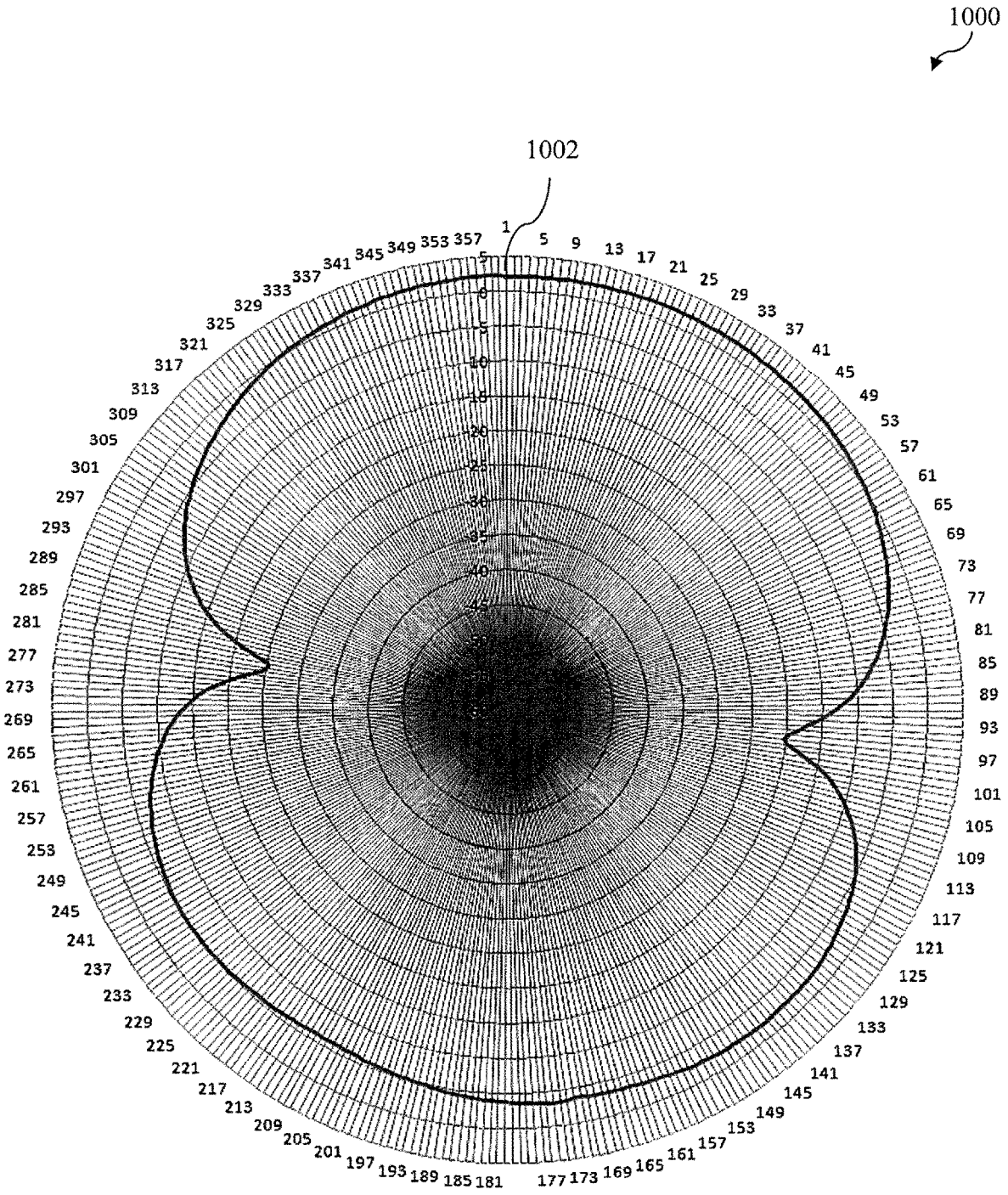
FIG. 10 is a diagram showing the antenna directivities in y-z plane for the example design in FIG. 5.

FIG. 10 is a diagram 1000 showing the antenna directivities in y-z plane (elevation plane) for the example design in FIG. 5. It is shown that the antenna has lowest gain in the bottom ground direction (about 270 degrees). The antenna gain 1002 in the top direction (about 95 degrees) is also very low. The direction having largest gain is about 20-degree slanting angles from x-y plane. This is the typical monopole antenna.

In various embodiments, the antenna may be capable of small dimensions that advantageously form a low profile structure with the height of the antenna at 0.06 wavelength of the lowest frequency, giving an average gain of 1 dBi in the radiating plane.

In the following, various aspects of this disclosure will be illustrated:

Example 1 is antenna. The antenna may include a radiating element configured in a bent monopole arrangement to provide a vertical polarization such that an omni-directional radiating characteristic is achieved. The antenna may include a feed and a feeding structure extending from the radiating element to the feed.

In Example 2, the subject matter of Example 1 may optionally include that the radiating element includes a plurality of slots formed at or edged from each side of the radiating element to increase an effective current path length of the radiating element.

In Example 3, the subject matter of Example 2 may optionally include that the plurality of slots increases the primary resonant frequency of the antenna.

In Example 4, the subject matter of any one of Examples 1 to 3 may optionally include a ground plane, where the radiating element is arranged substantially parallel to the ground plane.

In Example 5, the subject matter of Example 4 may optionally include that the surface area of the radiating element is smaller than the ground plane.

In Example 6, the subject matter of Example 4 may optionally include a supporting structure to support the feeding structure, a first substrate, where the radiating element is disposed on one side of the first substrate, and a second substrate, where the ground plane is disposed on one side of the second substrate.

In Example 7, the subject matter of Example 6 may optionally include that the supporting structure is a cylindrical structure extending from the radiating element to a supporting substrate or plate.

In Example 8, the subject matter of Example 6 may optionally include a plurality of stubs extending from the radiating element to the second substrate, and arranged around the supporting structure.

In Example 9, the subject matter of Example 8 may optionally include that the plurality of stubs are non-shorted to the ground plane to avoid forming a loop antenna.

In Example 10, the subject matter of Example 8 may optionally include that the arrangement of the plurality of stubs enlarges an impedance bandwidth of the antenna.

In Example 11, the subject matter of Example 10 may optionally include that the impedance bandwidth of the antenna is determined by a distance from the plurality of stubs to edges of the first substrate.

Example 12 is a method of providing an antenna. The method may bend a pole of the antenna to form a radiating element and a feeding structure, the feeding structure extending from the radiating element to a feed, the radiating element providing a vertical polarization such that an omni-directional radiating characteristic is achieved. And the method may provide a ground plane, the radiating element arranged substantially parallel to the ground plane.

In Example 13, the method of Example 12 may optionally etch a plurality of slots at each side of the radiating element to increase an effective current path length of the radiating element.

In Example 14, the subject matter of Example 13 may optionally include that the plurality of slots increases the primary resonant frequency of the antenna.

In Example 15, the subject matter of any one of Examples 12 to 14 may optionally include that the surface area of the radiating element is smaller than the ground plane.

In Example 16, the subject matter of any one of Examples 12 to 15 may optionally include that the bending of the pole further forms a supporting structure that supports the feeding structure, the radiating element being disposed on one side of a first substrate, the ground plane being disposed on one side of a second substrate.

In Example 17, the subject matter of Example 16 may optionally include that the supporting structure is a cylindrical structure extending from the radiating element to a supporting substrate or plate.

In Example 18, the method of Example 16 may optionally provide a plurality of stubs extending from the radiating element to the second substrate, and arranged around the supporting structure.

In Example 19, the subject matter of Example 18 may optionally include that the plurality of stubs are non-shorted to the ground plane to avoid forming a loop antenna.

In Example 20, the subject matter of Example 18 may optionally include that an arrangement of the plurality of stubs enlarges an impedance bandwidth of the antenna.

It will be appreciated to a person skilled in the art that the terminology used herein is for the purpose of describing various embodiments only and is not intended to be limiting of the present invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

It is understood that the specific order or hierarchy of blocks in the processes/flowcharts disclosed is an illustration of exemplary approaches. Based upon design preferences, it is understood that the specific order or hierarchy of blocks in the processes/flowcharts may be rearranged. Further, some blocks may be combined or omitted. The accompanying method claims present elements of the various blocks in a sample order, and are not meant to be limited to the specific order or hierarchy presented.

The previous description is provided to enable any person skilled in the art to practice the various aspects described herein. Various modifications to these aspects will be readily apparent to those skilled in the art, and the generic principles defined herein may be applied to other aspects. Thus, the claims are not intended to be limited to the aspects shown herein, but is to be accorded the full scope consistent with the language claims, wherein reference to an element in the singular is not intended to mean "one and only one" unless specifically so stated, but rather "one or more." The word "exemplary" is used herein to mean "serving as an example, instance, or illustration." Any aspect described herein as "exemplary" is not necessarily to be construed as preferred or advantageous over other aspects. Unless specifically stated otherwise, the term "some" refers to one or more. Combinations such as "at least one of A, B, or C," "one or more of A, B, or C," "at least one of A, B, and C," "one or more of A, B, and C," and "A, B, C, or any combination thereof" include any combination of A, B, and/or C, and may include multiples of A, multiples of B, or multiples of C. Specifically, combinations such as "at least one of A, B, or C," "one or more of A, B, or C," "at least one of A, B, and C," "one or more of A, B, and C," and "A, B, C, or any combination thereof" may be A only, B only, C only, A and B, A and C, B and C, or A and B and C, where any such combinations may contain one or more member or members of A, B, or C. All structural and functional equivalents to the elements of the various aspects described throughout this disclosure that are known or later come to be known to those of ordinary skill in the art are expressly incorporated herein by reference and are intended to be encompassed by the claims. Moreover, nothing disclosed herein is intended to be dedicated to the public regardless of whether such disclosure is explicitly recited in the claims. The words "module," "mechanism," "element," "device," and the like may not be a substitute for the word "means." As such, no claim element is to be construed as a means plus function unless the element is expressly recited using the phrase "means for."

What is claimed is:

1. An antenna, comprising:

a radiating element configured in a bent monopole arrangement to provide a vertical polarization such that an omni-directional radiating characteristic is achieved;

a feed;

a feeding structure extending from the radiating element to the feed;

a ground plane;

a supporting structure configured to support the feeding structure;

a first substrate, wherein the radiating element is disposed on one side of the first substrate;

a second substrate, wherein the ground plane is disposed on one side of the second substrate; and a plurality of stubs extending from the radiating element to the second substrate, and arranged around the supporting structure, wherein the plurality of stubs are non-shorted to the ground plane to avoid forming a loop antenna.

2. The antenna of claim 1, wherein the radiating element comprises a plurality of slots formed at or edged from each side of the radiating element to increase an effective current path length of the radiating element.

3. The antenna of claim 2, wherein the plurality of slots increase a primary resonant frequency of the antenna.

4. The antenna of claim 1, wherein the radiating element is arranged substantially parallel to the ground plane.

5. The antenna of claim 4, wherein a surface area of the radiating element is smaller than the ground plane.

6. The antenna of claim 1, wherein the supporting structure is a cylindrical structure extending from the radiating element to a supporting substrate or plate.

7. The antenna of claim 1, wherein an arrangement of the plurality of stubs enlarges an impedance bandwidth of the antenna.

8. The antenna of claim 7, wherein the impedance bandwidth of the antenna is determined by a distance from the plurality of stubs to edges of the first substrate.

9. A method of providing an antenna, comprising:

bending a pole of the antenna to form a radiating element and a feeding structure, the feeding structure extending from the radiating element to a feed, wherein the radiating element provides a vertical polarization such that an omni-directional radiating characteristic is achieved; and providing a ground plane, wherein the radiating element is arranged substantially parallel to the ground plane, wherein the bending the pole further forms a supporting structure that supports the feeding structure, wherein the radiating element is disposed on one side of a first substrate, wherein the ground plane is disposed on one side of a second substrate; and providing a plurality of stubs extending from the radiating element to the second substrate, the plurality of stubs being arranged around the supporting structure, and wherein the plurality of stubs are non-shorted to the ground plane to avoid forming a loop antenna.

10. The method of claim 9, further comprising:

etching a plurality of slots at each side of the radiating element to increase an effective current path length of the radiating element.

11. The method of claim 10, wherein the plurality of slots increase a primary resonant frequency of the antenna.

12. The method of claim 9, wherein a surface area of the radiating element is smaller than the ground plane.

13. The method of claim 9, wherein the supporting structure is a cylindrical structure extending from the radiating element to a supporting substrate or plate.

14. The method of claim 9, wherein an arrangement of the plurality of stubs enlarges an impedance bandwidth of the antenna.

* * * * *